United States Patent [19]

Graser

[11] Patent Number: 4,478,334

[45] Date of Patent: Oct. 23, 1984

[54] SLEEVE STYLE BEVERAGE PACKAGE

[75] Inventor: Earl J. Graser, Monroe, La.

[73] Assignee: Manville Service Corporation, Denver, Colo.

[21] Appl. No.: 362,209

[22] Filed: Mar. 26, 1982

[51] Int. Cl.[3] ..... B65D 5/44

[52] U.S. Cl. ..... 206/427; 206/141; 206/155; 229/52 BC; 229/40; 229/52 B

[58] Field of Search ..... 229/52, 52 B, 52 BC, 229/40, 43, 38, 37 R, 39 R, 45 R, 17 B, 89; 206/140, 141, 148, 427, 434, 607, 611, 155

[56] References Cited

U.S. PATENT DOCUMENTS

| | | | |
|---|---|---|---|
| 2,508,909 | 5/1950 | Evans et al. | 206/491 |
| 2,922,561 | 1/1960 | Currivan | 206/155 X |
| 2,990,997 | 7/1961 | Weiss | 206/140 |
| 3,129,843 | 4/1964 | Weiss | 206/140 |
| 3,186,587 | 6/1965 | Englander et al. | 206/140 |
| 3,556,386 | 1/1971 | Ganz | 229/40 |
| 3,692,232 | 9/1972 | Helms | 229/52 B |
| 3,894,681 | 7/1975 | Arneson et al. | 229/17 B |
| 3,945,560 | 3/1976 | Harrelson et al. | 229/40 |
| 3,974,911 | 8/1976 | Graser | 206/141 |
| 3,994,432 | 11/1976 | Kirby, Jr. | 229/52 B |
| 4,331,289 | 5/1982 | Killy | 229/52 B |
| 4,364,509 | 12/1982 | Holley, Jr. et al. | 229/17 B |
| 4,396,143 | 8/1983 | Killy | 229/17 B |

*Primary Examiner*—Allan N. Shoap
*Assistant Examiner*—Bryon Gehman
*Attorney, Agent, or Firm*—Ronald M. Halvorsen; John D. Lister

[57] ABSTRACT

An improved sleeve-style beverage package designed to be shipped to a canning operation in a flat form and then wrapped around a group of cans or beverage bottles. The package comprises novel top primary panel locking means formed on the pair of overlapping top panels. The top panels also contain handle means which may form a secondary top panel locking means to secondarily lock the top panels together whenever the package is closed and locked.

4 Claims, 4 Drawing Figures

SLEEVE STYLE BEVERAGE PACKAGE

BACKGROUND OF THE INVENTION

This invention relates generally to beverage packages and more particularly to a new and novel sleeve style beverage package having improved package integerity without the use of adhesive in the overlapped margins of the locking portion of the beverage package.

It is known in the art of sleeve style beverage package design to provide a flat production blank of the ultimate package. The production blank is shipped to a canning operation in the flat form and is inserted into a machine design to insert the required cans or bottles into the package. Thereafter the required locks on the package which are designed to lock the overlapping margins are locked together and the end panels of the package are either locked together or glued together.

The structural integrity of such a package is important since care must be taken to see that the locks do not disengage. A lock separation would allow the cans or bottles to be discharged to the ground where they may injure the customer by landing on his or her foot. When utilizing glued margins in place of locking structures glue nozzles and the related equipment required with the glue nozzle add to the increased cost of the packaging machine and also add to the increased maintenance required in order to maintain the glue nozzles.

SUMMARY OF THE INVENTION

In order to overcome the difficulties inherent in prior art type of packages as before described, there is provided by the subject invention a new and improved sleeve style beverage package which is designed to be shipped to a canning operation in a flat form and then wrapped around a group of cans or beverage bottles. The package has formed on the top thereof a novel top primary panel locking means formed on the pair of overlapping top panels. The top panels also contain handle means which may form a secondary top panel locking means to secondarily lock the top panels together whenever the package is closed and locked.

Accordingly it is an object and advantage of the invention to provide a new and improved sleeve style beverage package having improved locking portions on the upper portion of the package and also having an improved secondary locking portion on the upper portions of the package to thereby eliminate the use of glue in gluing the handle portion of the package together.

Another object and advantage of the invention is to provide a new and improved sleeve style package which uses a slide-in style lock as the primary top panel lock and may use a portion of the handle means as a secondary punch style top panel lock when desired.

These and other objects and advantages of the invention will become apparent from a review of the drawings and from a study of the specification hereinafter describing the preferred embodiment.

DESCRIPTION OF THE PREFERRED EMBODIMENT

Figure 1:
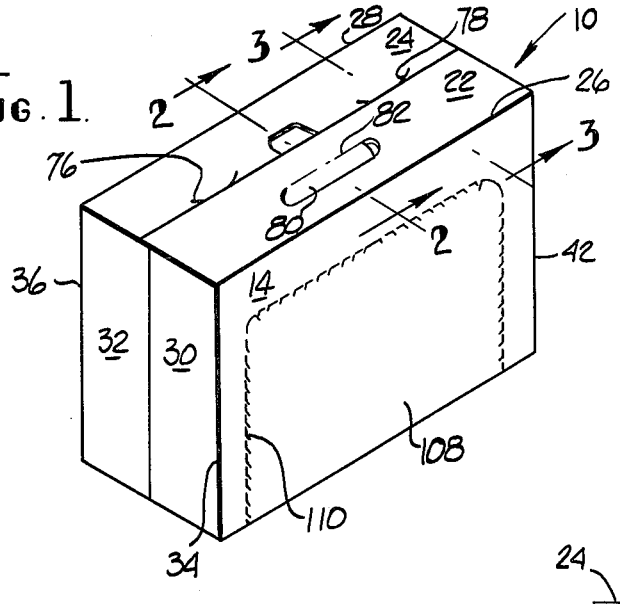
FIG. 1 is a perspective view of the Applicant's new and novel sleeve-style beverage package.

Referring now to FIG. 1 of the drawing, there is shown a sleeve-style beverage package of the type taught by the Applicant's invention and shown generally by the numeral 10. The package 10 is formed from a bottom panel 12, not shown in FIG. 1 but shown in FIG. 4, and a pair of side panels 14 and 16 hingedly attached to opposite sides of the bottom panel 12 by means of score lines 18 and 20. A pair of overlapping top panels 22 and 24 are hingedly attached to the side panels 14 and 16 by means of the score lines 26 and 28.

The package shown in FIG. 1 also has formed thereon a pair of end flaps 30 and 32 hingedly attached to the side panels 14 and 16 by means of the score lines 34 and 36. On the opposite side of the package shown in FIG. 1, a pair of end flaps 38 and 40 are hingedly attached to the side panels 14 and 16 by means of the score lines 42 and 44. The end flaps 38 and 40 are not seen in FIG. 1 but may be more clearly seen in FIG. 4 of the drawing which is a plan view of the production blank for manufacturing the carrier shown in FIG. 1.

A pair of top glue flaps 46 and 48 are hingedly attached to the top panel 22 by means of the score line 50 and 52. In a similar manner, a pair of glue flaps 54 and 56 are hingedly attached to the top panel 24 by means of the score line 58 and 60. A pair of glue flaps 62 and 64 are hingedly attached to the bottom panel 21 by means of the score lines 66 and 68. The glue flaps 46, 48, 54, 56, 62 and 64 are positioned inside the package shown in FIG. 1 whenever it is erected.

Adhesive means in the form of hot melt or other adhesive are formed on the glue flaps 46, 48, 54 and 56 as well as on the bottom glue flaps 62 and 64 for adhesively securing the end flaps 30, 38, 32 and 40 together to enclose the ends of the package as is known in the art.

A primary top panel locking means is formed on the overlapping top panels 22 and 24 to lock the panels together. The primary top locking means comprises a plurality of male tabs 70 and 72 formed on the edge 74 of the top panel 22 and further comprises a plurality of female tab receiving slots 76 and 78 formed on the other of the overlapping top panels which would be the top panel 24.

The package 10 also has formed thereon handle means, formed in each overlapping top panel 22 and 24 with the handle means comprising in part a secondary top panel locking means to secondarily lock the top panels together. The handle means comprises a handle tab 80 which is hingedly attached to the top panel 22 by means of the score line 82 and the cut line 84. The secondary top panel locking means comprises a male tab 100 hingedly attached to the outer top panel 22.

Figure 4:
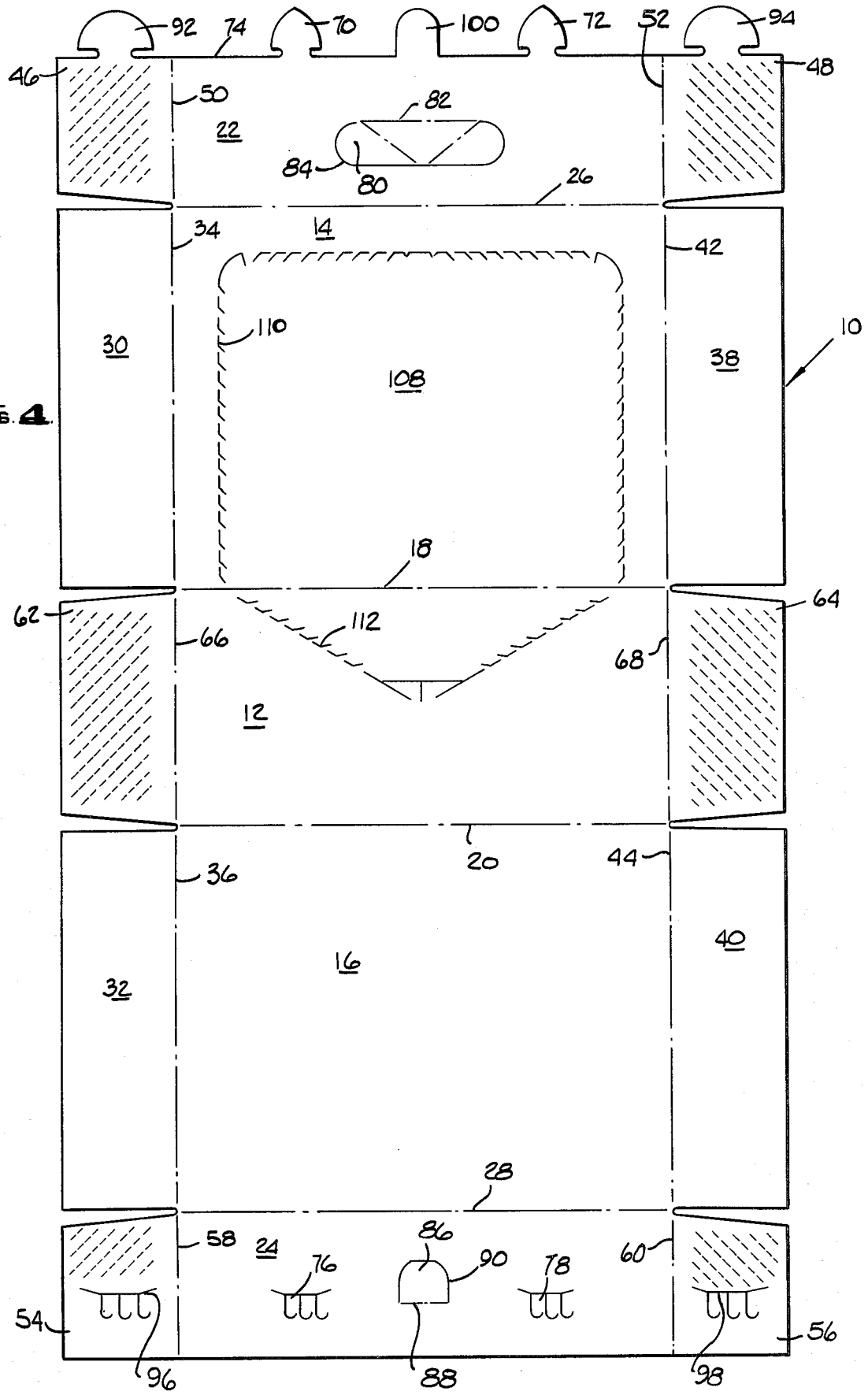
FIG. 4 is a plan view of the production blank utilized to manufacture the package shown in FIGS. 1 through 3.

The package shown in the drawings and detailed in FIG. 4 may also have formed thereon a male tab 92 formed on the top glue flap 46 as well as a male tab 94 formed on the top glue flap 48. In a similar manner, the top glue flap 54 would have formed thereon a mating female slot 96 for receipt of the male tab 92. In a similar manner, the top glue flap 56 would have formed thereon a female slot 98 for receipt of the male tab 94.

Figure 2:
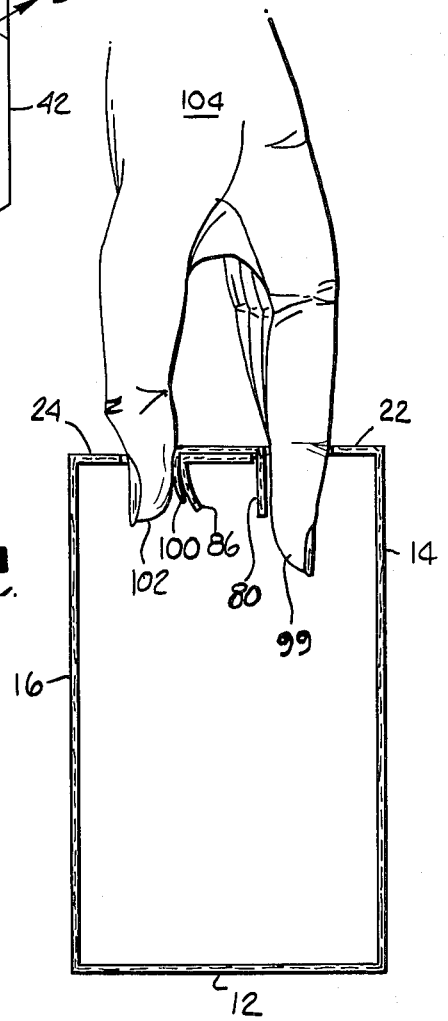
FIG. 2 is a side sectional view, taken along line 2—2 of FIG. 1, showing the operation of the handle and the secondary top panel locking means.
Figure 3:
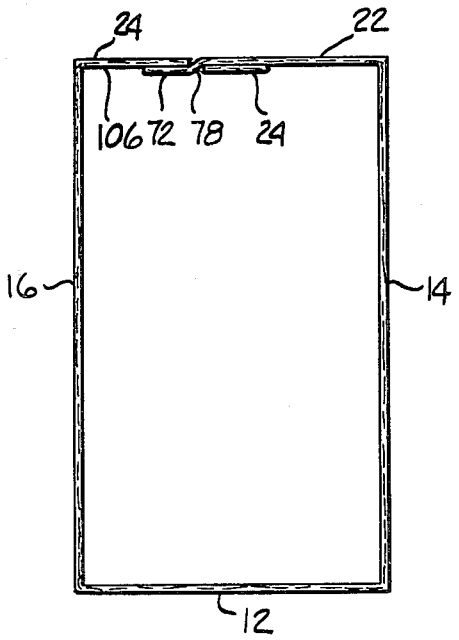
FIG. 3 is a side sectional view, taken along line 3—3 of FIG. 1, showing the operation of the primary top panel locking means.

Referring now to FIGS. 2 and 3 of the drawing there can be seen in FIG. 2 a sectional view, taken along line 2—2 of FIG. 1 showing how the handle tab 80 has been turned inwardly and downwardly into the inside of the package 10 to allow the fingers 99 of the user's hand to be inserted into the opening formed therein in order to lift the package upwardly. It has been found from experimentation that the size of the handle slot should preferably be such as to allow at least four fingers 99 of the user's hand to be inserted into the opening. It can also be seen in FIG. 2 how the secondary top panel locking tab 100 which has been formed on the edge 74 of the outer top panel 22 may be folded downwardly against the male tab 86 and may be positioned somewhat inwardly of the package whenever the thumb 102 of the user's hand 104 is inserted in the opening formed by the tabs. It can be seen in FIG. 1 that the secondary top panel locking means is positioned in proximity to the handle tab 80 so that the thumb 102 of the user would be automatically positioned in that opening should the purchaser of the production blank desire to use the secondary top panel locking means in the package.

Referring now to FIG. 3 of the drawing, there is shown a sectional view, taken along line 3—3 of FIG. 2 showing the primary top panel locking tab 72 positioned within its mating female slot 78 to be positioned against the underside 106 of the top panel 24 to primarily lock the top panels together in conjunction with the primary male locking tab 70 and its maturing female slot 76. It is within the spirit and scope of the invention that more than two primary male locking tabs may be utilized in the top panel to lock the top panels together. There is also formed in the side panel 14 a removable section 108 which is formed therein by means of the die cuts 110 formed in the side panel 14 as well as the die cuts 112 formed in the bottom panel 12.

From the foregoing, it can be seen that there has been provided by the subject invention a new and novel sleeve-type beverage package having a primary top locking means in the form of a plurality of male locking tabs and female locking slots which may be utilized to lock the top panels of the package. A handle means is formed in the top package and may comprise in part a secondary top panel locking means in the form of a secondary locking tab which is activated whenever the user's thumb is inserted into the tab opening and is used to secondarily lock the top panels together. It can be seen specifically in FIG. 2 how the user's hand 104 grips the top panels with the thumb 102 forcing the secondary top panel lock to flex inwardly to secondarily lock the top panels together. The top panels thereby may be primarily and secondarily locked across the entire top of the package as desired by the purchaser of the production blank.

From the foregoing, it can be seen and many changes may be made in the arrangement of the parts and the lay-out of the specific parts of the package in relation to each other without departing from the spirit and scope of the invention. Nevertheless, the invention is not to be limited to the exact embodiment shown which has been shown and described by way of illustration only.

Having described my invention, I claim:

1. A sleeve-style beverage package, comprising:

(a) a bottom panel;

(b) a pair of side panels hingedly attached to opposite sides of the bottom panel;

(c) a pair of overlapping outer and inner top panels hingedly attached to opposite sides of the side panels;

(d) end flaps hingedly attached to opposite sides of the side panels;

(e) top and bottom glue flaps hingedly attached to opposite sides of the top and bottom panels;

(f) adhesive means, formed on the top and bottom glue flaps, for adhesively securing the end flaps to the glue flaps to enclose the ends of the package;

(g) primary top panel locking means formed on the overlapping top panels to lock the top panels together the primary top panel locking means comprising a plurality of male tabs on the outer top panel and a plurality of female tab receiving slots on the inner top panel; and (h) handle means, formed in each overlapping top panel, the handle means comprising an elongated opening in the outer top panel designed for receipt of four fingers and an opening in the inner panel designed for receipt of a thumb, said finger opening and said thumb opening being adjacent and defining therebetween a double layered handle section and said finger opening and said thumb opening each having a handle tab hingedly secured thereto adjacent said double layered handle section to be folded down along the double layered handle section when fingers and a thumb are inserted into said finger and thumb openings and said handle means further comprising in part secondary top panel locking means to secondarily lock the top panels together, said secondary top panel locking means comprising a secondary male locking tab on said outer top panel which overlays the thumb opening and is inserted into the thumb opening when a thumb is inserted into the thumb opening.

2. The beverage package as defined in claim 1 further comprising a male locking tab on each of the glue flaps of the outer top panel inserted in a female tab receiving slot on each of the glue flaps of the inner top panel.

3. A production blank for a sleeve-style beverage package, comprising:

(a) a bottom panel, the bottom panel having formed thereon on opposite sides thereof a pair of glue flaps;

(b) a pair of side panels hingedly attached to opposite sides of the bottom panel, each side panel having formed thereon on opposite sides thereof an end flap;

(c) an outer top panel hingedly attached to one of the side panels, the outer top panel having formed thereon on opposite sides thereof a glue flap;

(d) an inner top panel hingedly attached to the other side panel, the inner top panel having formed thereon on opposite sides thereof a glue flap;

(e) primary top panel locking means formed on the outer and inner top panel, the primary top panel locking means comprising a plurality of male tabs on the outer top panel and a plurality of female tab receiving slots on the inner top panel; and (f) handle means, formed on the outer and inner top panel comprising an elongated opening in the outer top panel designed for receipt of four fingers and an opening in the inner top panel designed for receipt of a thumb, said finger opening and said thumb opening each having a handle tab hingedly secured thereto to be folded down to form the finger opening and thumb opening and said handle means further comprising a secondary top panel locking means to secondarily lock the top panels together, said secondary top panel locking means comprising a secondary male locking tab on said outer top panel adapted to overlay the thumb opening in the inner top panel and to be inserted into the thumb opening.

4. The production blank as defined in claim 3 further comprising a male locking tab of each of the glue flaps of the outer top panel and further comprising a female tab receiving slot on each of the glue flaps of the inner top panel.

* * * * *